US006442847B1

(12) United States Patent
Chen

(10) Patent No.: US 6,442,847 B1
(45) Date of Patent: Sep. 3, 2002

(54) PORTABLE PUNCHING MACHINE

(76) Inventor: Tung-Hsien Chen, 2/F-3, No. 73, Chiaohsiao St., Keelung City (TW)

( * ) Notice: Subject to any disclaimer, the term of this patent is extended or adjusted under 35 U.S.C. 154(b) by 0 days.

(21) Appl. No.: 09/854,533

(22) Filed: May 15, 2001

(51) Int. Cl.[7] ..... B26D 5/12; B26F 1/14
(52) U.S. Cl. ..... 30/362; 30/228
(58) Field of Search ..... 30/361, 362, 366, 30/367, 368, 228, 277.4; 83/552, 690

(56) References Cited

U.S. PATENT DOCUMENTS

| | | | | | |
|---|---|---|---|---|---|
| 3,025,600 | A | * | 3/1962 | Leibinger | 30/360 |
| 5,233,749 | A | * | 8/1993 | Saito et al. | 30/362 |
| 5,416,975 | A | * | 5/1995 | Saito et al. | 30/362 |
| 5,598,635 | A | * | 2/1997 | Saito | 30/362 |
| 5,630,277 | A | * | 5/1997 | Kimura | 30/362 |
| 6,282,796 | B1 | * | 9/2001 | Lin | 30/364 |

* cited by examiner

*Primary Examiner*—Hwei-Slu Payer
(74) *Attorney, Agent, or Firm*—Rosenberg, Klein & Lee

(57) ABSTRACT

A portable punching machine includes a pneumatic cylinder controlled to reciprocate a piston rod, and a punching mechanism coupled driven by the piston rod to punch holes on a metal workpiece, the punching mechanism including a locating block fixedly fastened to the pneumatic cylinder, the locating block having a plurality of bottom notches and a center through hole adapted to receive the piston rod of the pneumatic cylinder, an actuating block and adapted to move the workpiece relative to the locating block upon movement of the piston rod, the actuating block having a plurality of peripheral side notches selectively coupled to the metal workpiece, and pairs of guide holes aligned at two sides of the peripheral side notches, and a plurality of punching tool assemblies adapted to make holes on the metal workpiece, each punching tool assembly including a barrel mounted in one guide hole of the actuating block, a set of spring washers mounted in one bottom notch of the locating block, a punching rod mounted in one bottom notch of the locating block and inserted through the set of spring washers and the barrel, and a punching die mounted on one guide hole of the actuating block and aimed at the barrel.

7 Claims, 8 Drawing Sheets

PORTABLE PUNCHING MACHINE

BACKGROUND OF THE INVENTION

The present invention relates to a punching machine and, more particularly, to a portable punching machine, which can be conveniently carried to the job site to punch metal workpieces.

Various drilling machines and punching machines have been disclosed for use to make holes on metal sheet materials, for enabling metal sheet materials to be fastened together by rivets or screw bolts. When using a drilling machine to make holes on metal sheet materials, the peripheral edge of each processed hole is coarse and must be ground. Regular drilling machines and punching machines for making holes on metal sheet materials are commonly heavy and not portable. FIG. 12 shows a conventional punching machine 6 for punching metal sheet materials 5. Metal sheet materials must be carried to the drilling or punching machine and processed to provide the desired holes. After processing, the metal sheet materials are carried to the job site for installation. If the processed holes of the metal sheet materials do not fit, the worker shall have to carry the metal sheet materials to the drilling or punching machine for processing again.

SUMMARY OF THE INVENTION

The present invention has been accomplished under the circumstances in view. It is one object of the present invention to provide a punching machine, which is portable. It is another object of the present invention to provide a portable punching machine, which can be used to punch holes on metal workpieces as well as to crimp metal workpieces. According to one embodiment of the present invention, the portable punching machine comprises a pneumatic cylinder controlled to reciprocate a piston rod, and a punching mechanism coupled driven by the piston rod to punch holes on a metal workpiece. The punching mechanism comprises a locating block fixedly fastened to the pneumatic cylinder, the locating block having a plurality of bottom notches and a center through hole adapted to receive the piston rod of the pneumatic cylinder, an actuating block and adapted to move the workpiece relative to the locating block upon movement of the piston rod, the actuating block having a plurality of peripheral side notches selectively coupled to the metal workpiece, and pairs of guide holes aligned at two sides of the peripheral side notches, and a plurality of punching tool assemblies adapted to make holes on the metal workpiece. Each punching tool assembly comprises a barrel mounted in one guide hole of the actuating block, a set of spring washers mounted in one bottom notch of the locating block, a punching rod mounted in one bottom notch of the locating block and inserted through the set of spring washers and the barrel, and a punching die mounted on one guide hole of the actuating block and aimed at the barrel. In another embodiment of the present invention, the locating block has a stepped crimping side facing the actuating block, and the actuating block has a stepped crimping side facing the stepped crimping side of the locating block and defining with the stepped crimping side a crimping mouth adapted to crimp the metal workpiece to be processed.

DETAILED DESCRIPTION OF THE PREFERRED EMBODIMENT

Figure 1:
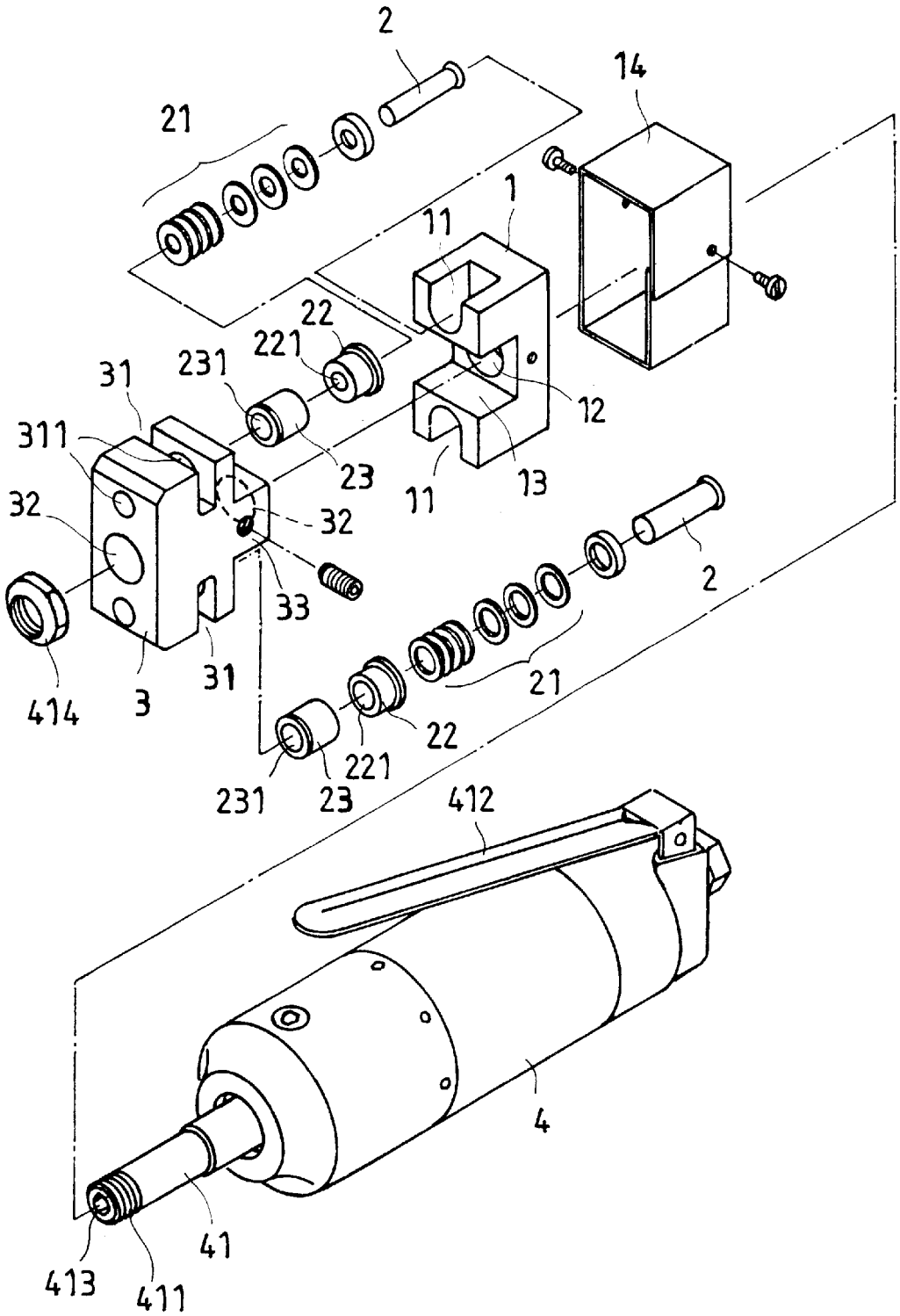
FIG. 1 is an exploded view of a portable punching machine according to a first embodiment of the present invention.
Figure 2:
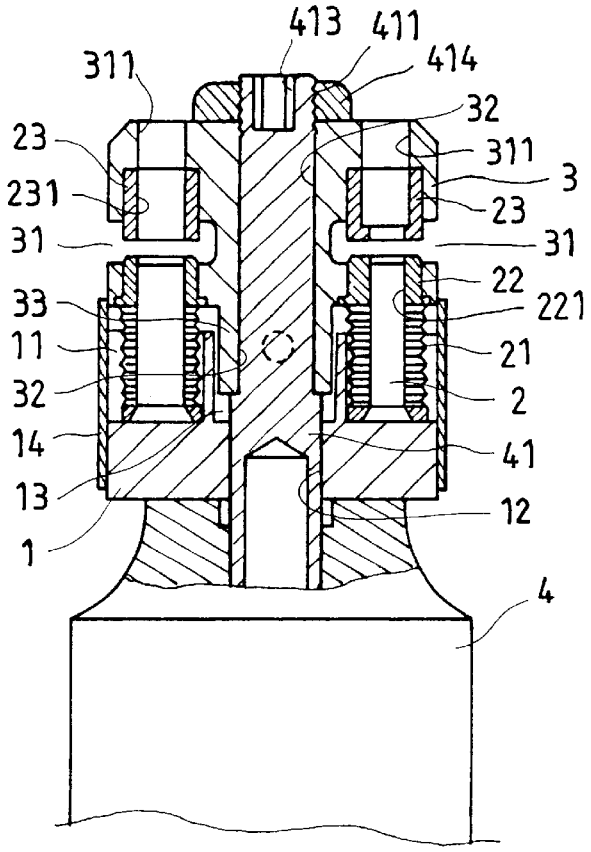
FIG. 2 is a sectional assembly view of the portable punching machine according to the first embodiment of the present invention.
Figure 3:
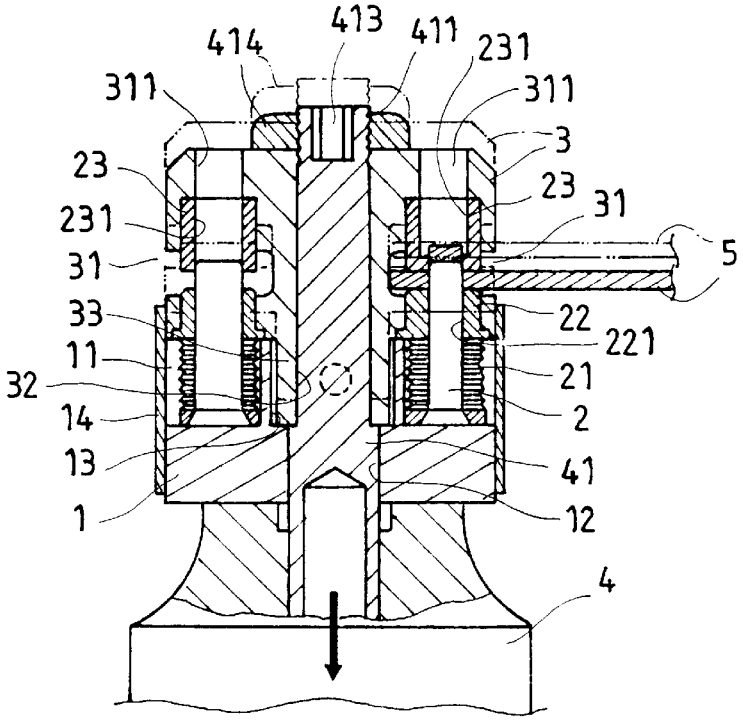
FIG. 3 is an applied view of the portable punching machine according to the first embodiment of the present invention.
Figure 4:
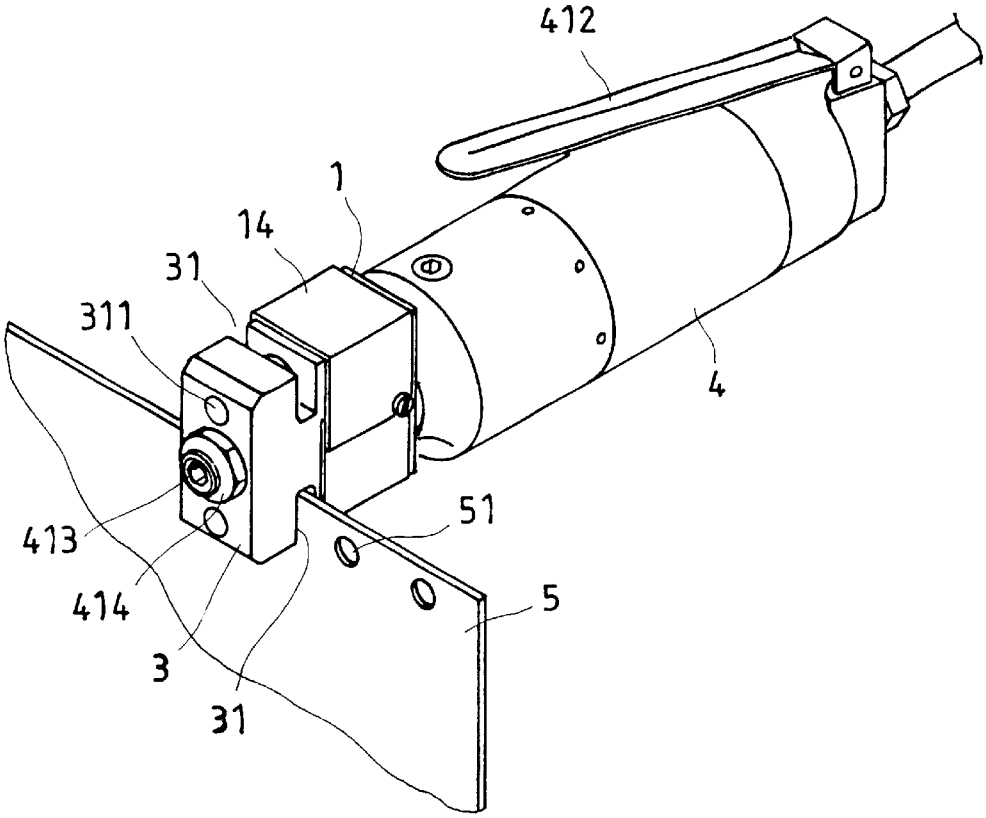
FIG. 4 is an elevational view of the first embodiment of the present invention, showing the actuating block attached to the metal workpiece.
Figure 4A:
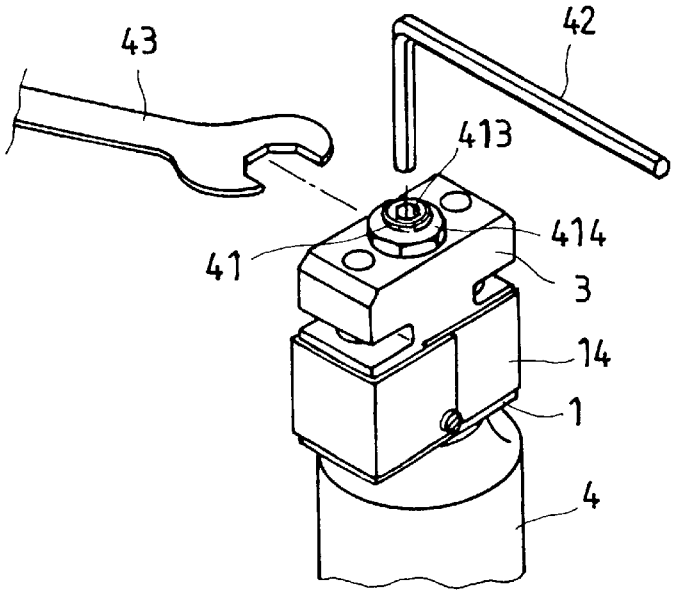
FIG. 4A illustrates the use of an open-end wrench and a hex wrench to dismount the portable punching machine according to the present invention.

Referring to FIGS. from 1 through 4, the present invention provides a punching machine adapted to punch holes on metal plates. The punching machine comprises a pneumatic cylinder 4 and a punching mechanism coupled to the piston rod 41 of the pneumatic cylinder 4. The piston rod 41 of the pneumatic cylinder 4 has a hexagonal end hole 413 axially disposed in the threaded front end 411 thereof. The punching mechanism comprises a locating block 1, at least one, for example, two punching tool assembles, and an actuating block 3. Each punching tool assembly is comprised of a barrel 22, a plurality of spring washers 21, a punching rod 2, and a punching die 23. The locating block 1 and the actuating block 3 have a respective center through hole 12 or 32 through which the threaded front end 411 of the piston rod 41 of the pneumatic cylinder 4 is inserted and screwed up with a nut 414. Because the piston rod 41 has a hexagonal end hole 413, it is easy to detach the actuating block 1 and the actuating block 3 from the pneumatic cylinder 4 with an open-end wrench 43 and a hex wrench 42 (see FIG. 4A). The locating block 1 comprises two bottom notches 11 adapted to receive the two punching tool assemblies. The actuating block 3 comprises two side notches 31, and two pairs of locating holes 311 respectively aligned at two sides of the two side notches 31. The two punching tool assemblies are respectively mounted in the bottom notches 11 of the locating block 1 and the guide holes 311 of the actuating block 3. The barrel 22 and punching die 23 of each punching tool assembly are respectively mounted in the locating holes 311 of the actuating block 3 at two sides of the side notches 31. The punching rod 2 is inserted through the respective set of spring washers 21 and the axial hole 221 of the corresponding barrel 22 and supported in one bottom notch 11 of the locating block 1. Further, a metal guard 14 is covered on the locating block 1 to hold the punching tool assemblies in the bottom notches 11 of the locating block 1. When turning the control handle 412 of the pneumatic cylinder 4 to the on position to move the piston rod 41 toward the inside of the pneumatic cylinder 4 after one side notch 31 of the actuating block 3 has been attached to the metal workpiece 5, the punching die 23 is suddenly moved with the actuating block 3 and the metal workpiece 5 toward the locating block 1, and therefore the punching rod 2 is pierced through the metal workpiece 5 to make a hole 51 on the metal workpiece 5, and the waste metal chip is forced out of the center through hole 231 of the punching die 23. After punching, the control handle 412 is turned backwards to the off position, the piston rod 41 is returned to the extended position, the metal workpiece 5 is moved with the actuating block 3 away from the punching rod 2, allowing the metal workpiece 5 to be removed from the punching machine. Further, the actuating block 3 has a top positioning head 33, and the locating block 1 has a bottom recess 13 adapted to receive the top positioning head 33 and to stop the actuating block 3 from rotary motion relative to the locating block 1 during punching. Further, the punching rods 2 of the punching tool assemblies can have different diameters to make holes of different diameters.

Figure 5:
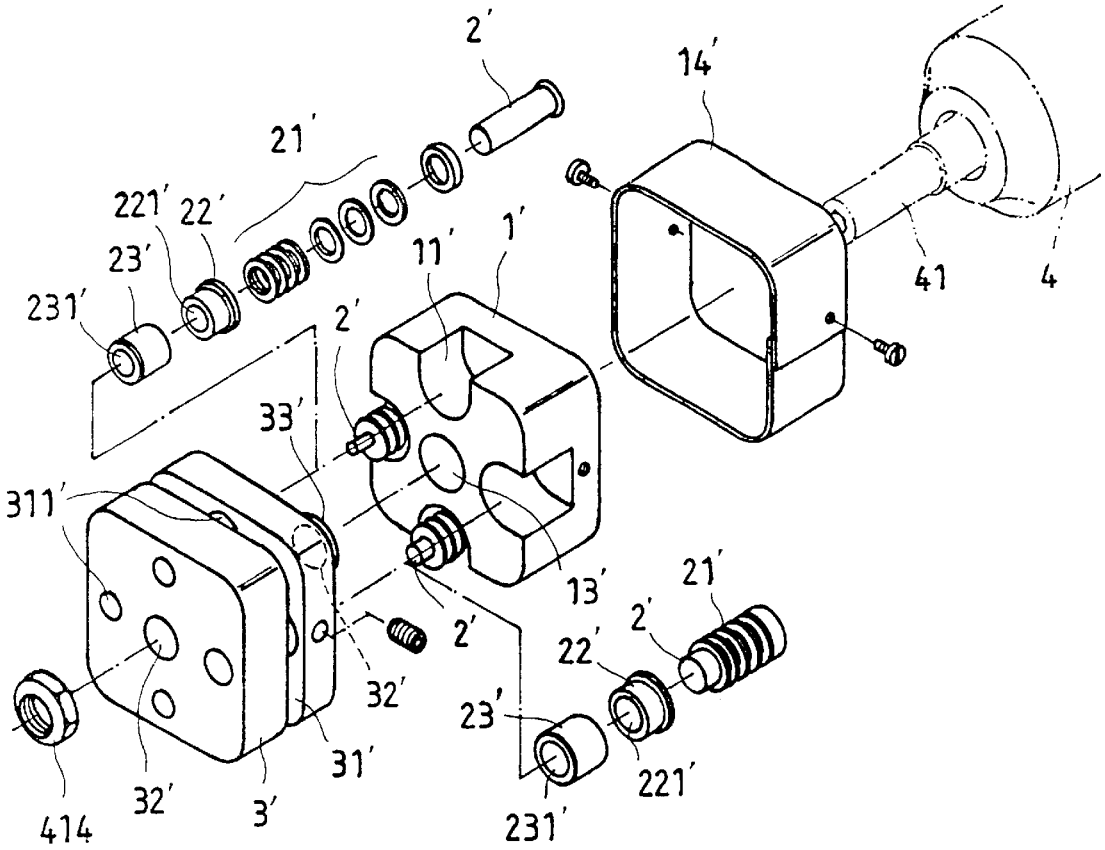
FIG. 5 is an exploded view of a portable punching machine according to a second embodiment of the present invention.
Figure 6:
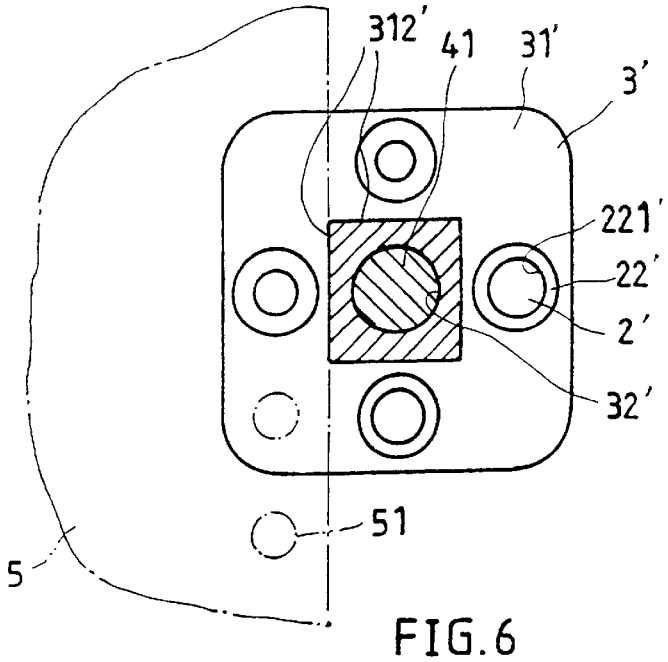
FIG. 6 is a cross-sectional view of the portable punching machine according to the second embodiment of the present invention.

FIGS. 5 and 6 show a punching machine according to a second embodiment of the present invention. According to this embodiment, the punching machine comprises a pneumatic cylinder 4 having a piston rod 41, an actuating block 3' mounted on the piston rod 41 of the pneumatic cylinder 4, a locating block 1' fastened to the piston rod 41 of the pneumatic cylinder 43 a nut 414 fastened to the piston rod 41 of the pneumatic cylinder 4 to secure the actuating block 3' to the piston rod 41 of the pneumatic cylinder 4, for enabling the actuating block 3' to be moved with the piston rod 41 relative to the locating block 1', four punching tool assemblies mounted in the locating block 1' and the actuating block 3', and a metal guard 14' covered on the locating block 1'. Each punching tool assembly is comprised of a punching rod 2', a set of spring washers 21', a barrel 22' having an axial hole 221', and a punching die 23' having a center through hole 231'. The locating block 1' has a center through hole 13' for the passing of the piston rod 41 of the pneumatic cylinder 4, and four bottom notches 11' equiangularly spaced around the center through hole 13' and adapted to receive the punching rod 2' and spring washers 21' of each punching tool assembly. The actuating block 3' comprises a center through hole 32' fastened to the piston rod 41 of the pneumatic cylinder 4, four side notches 31' disposed in communication with one another at four sides around the center through hole 32' for selectively coupled to the metal workpiece 5 (see FIG. 6), and four pairs of locating holes 311' aligned a two sides of the side notches 31' and respectively aimed at the bottom notches 11' of the locating block 1' and adapted to receive the barrel 22' and punching die 23' of each punching tool assembly. Further, the actuating block 3' has a square center neck 312' surrounded by the side notches 31' for stopping against one side of the workpiece 5 to serve as a reference line, and a top positioning head 33' for engaging into the center through hole 13' of the locating block 1' during punching.

Figure 7:
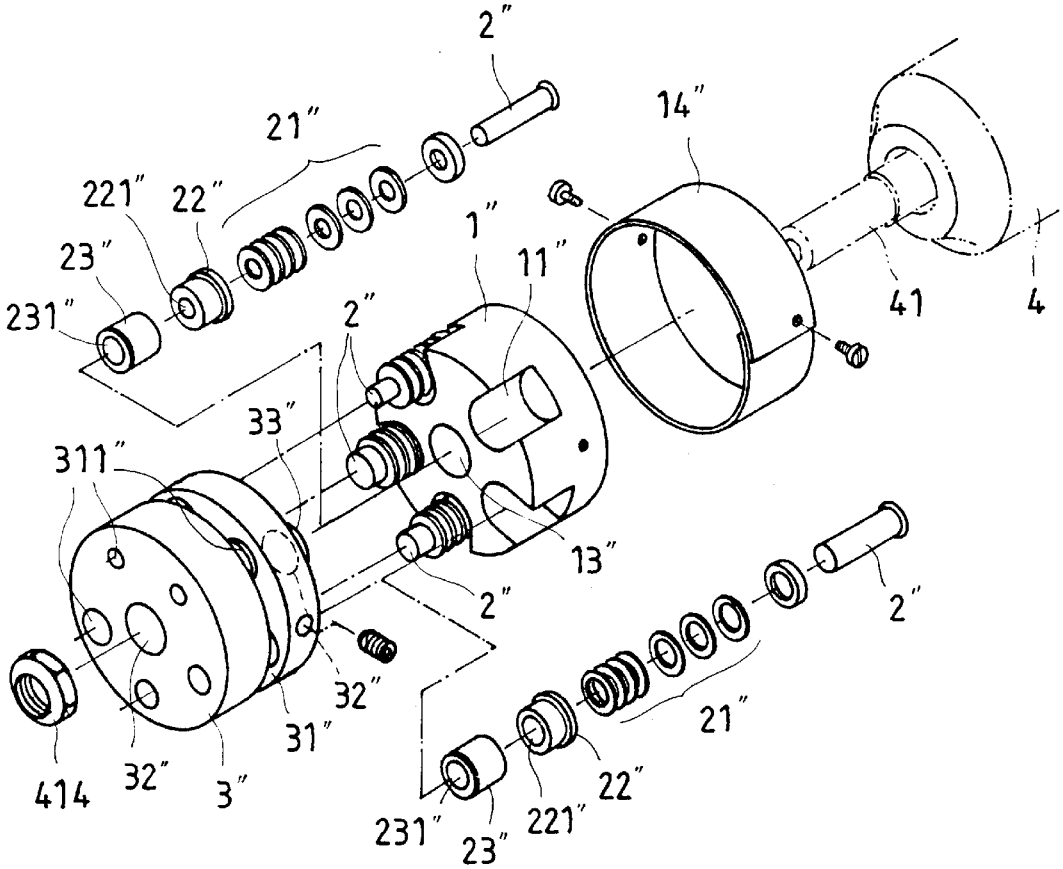
FIG. 7 is an exploded view of a portable punching machine according to a third embodiment of the present invention.
Figure 8:
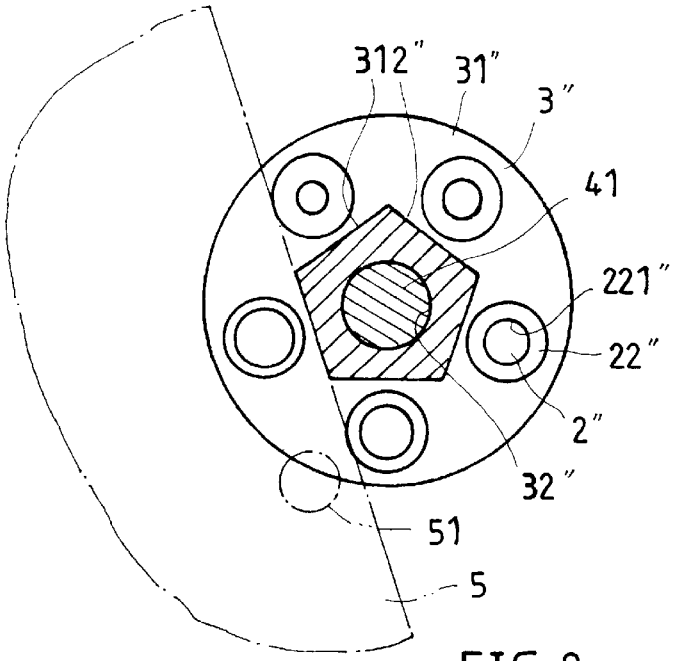
FIG. 8 is a cross-sectional view of the portable punching machine according to the third embodiment of the present invention.

FIGS. 7 and 8 show a punching machine according to a third embodiment of the present invention. According to this embodiment, the punching machine comprises a pneumatic cylinder 4 having a piston rod 41, a circular actuating block 3" mounted on the piston rod 41 of the pneumatic cylinder 4, a circular locating block 1" fastened to the piston rod 41 of the pneumatic cylinder 4, a nut 414 fastened to the piston rod 41 of the pneumatic cylinder 4 to secure the actuating block 3" to the piston rod 41 of the pneumatic cylinder 4, for enabling the actuating block 3" to be moved with the piston rod 41 relative to the locating block 1", five punching tool assemblies mounted in the locating block 1" and the actuating block 3", and a metal guard 14" covered on the locating block 1". Each punching tool assembly is comprised of a punching rod 2", a set of spring washers 21", a barrel 22" having an axial hole 221", and a punching die 23" having a center through hole 231". The locating block 1" has a center through hole 13" for the passing of the piston rod 41 of the pneumatic cylinder 4, and five peripheral bottom notches 11" equiangularly spaced around the center through hole 13" and adapted to receive the punching rod 2" and spring washers 21" of each punching tool assembly. The actuating block 3" comprises a center through hole 32" fastened to the piston rod 41 of the pneumatic cylinder 4, a peripheral groove 31" disposed around the center through hole 32", and five pairs of locating holes 311" aligned a two sides of the side notches 31" and respectively aimed at the bottom notches 11" of the locating block 1" and adapted to receive the barrel 22" and punching die 23" of each punching tool assembly. Further, the actuating block 3" has a hexagonal center neck 312" surrounded by the peripheral groove 31" for stopping against one side of the workpiece 5 to serve as a reference line, and a top positioning head 33" for engaging into the center through hole 13" of the locating block 1" during punching.

Figure 9:
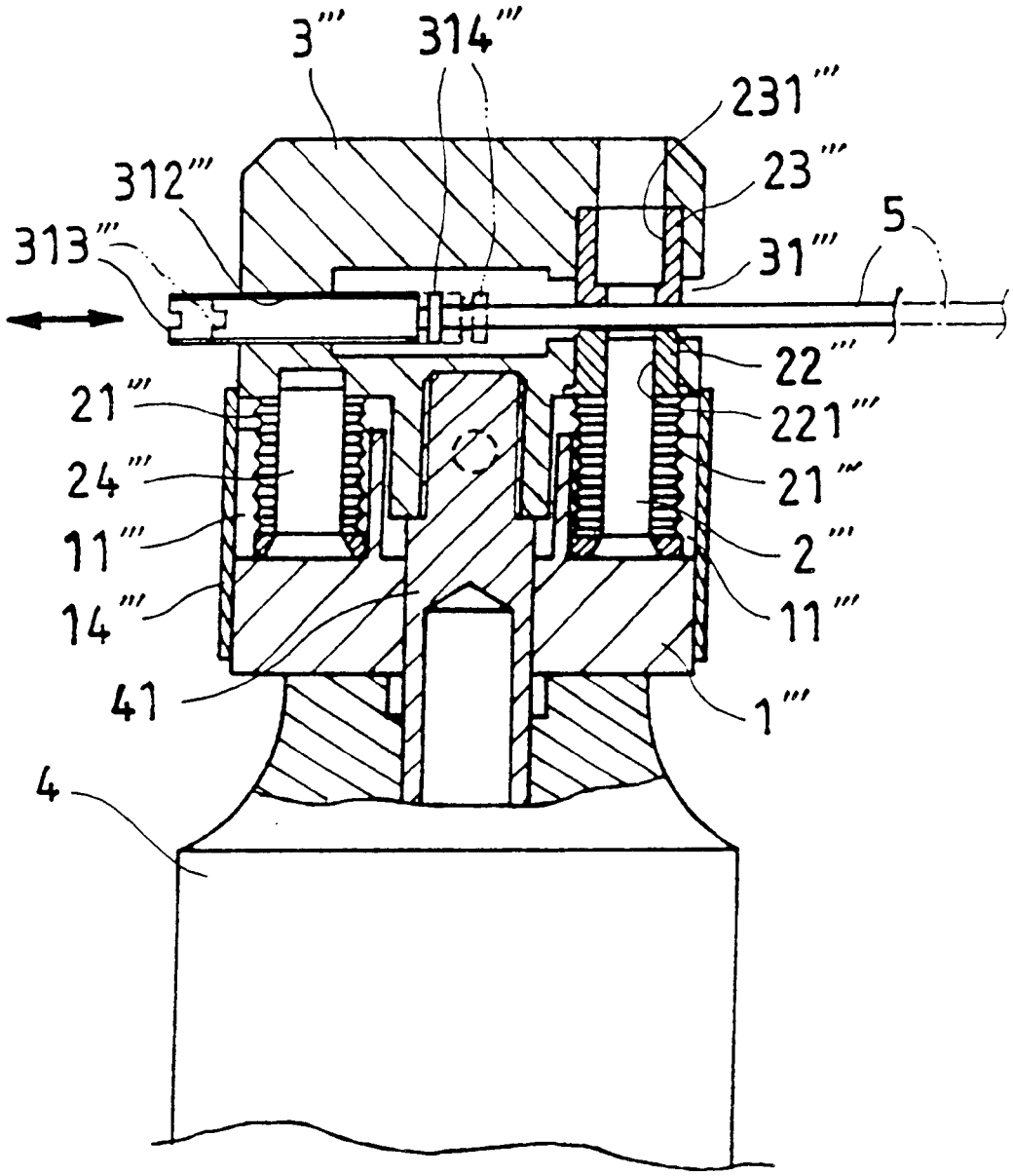
FIG. 9 is a sectional view showing the application of a portable punching machine according to a fourth embodiment of the present invention.

FIG. 9 shows a punching machine according to a fourth embodiment of the present invention. According to this embodiment, the punching machine comprises a pneumatic cylinder 4 having a piston rod 41, an actuating block 3''', a locating block 1''', a punching tool assembly mounted in the locating block 1''' and the actuating block 3''', and a metal guard 14''' covered on the locating block 1'''. The punching tool assembly is comprised of a punching rod 2''', a set of spring washers 21''', a barrel 22''' having an axial hole 221''', and a punching die 23''' having a center through hole 231'''. The locating block 1''' has two bottom notches 11''' adapted to receive the punching rod 2''' and spring washers 21''' of the punching tool assembly and a guide rod 24''' with another set of spring washers 21'''. An adjustment screw 313''' is mounted in one side screw hole 312 '''' of the actuating block 3''', and controlled to move a stop block 314''' in the side notch 31 ''' of the actuating block 3''' to limit the depth of the insertion of the metal workpiece 5 in the side notch 31''' of the actuating block 3'''.

Figure 10:
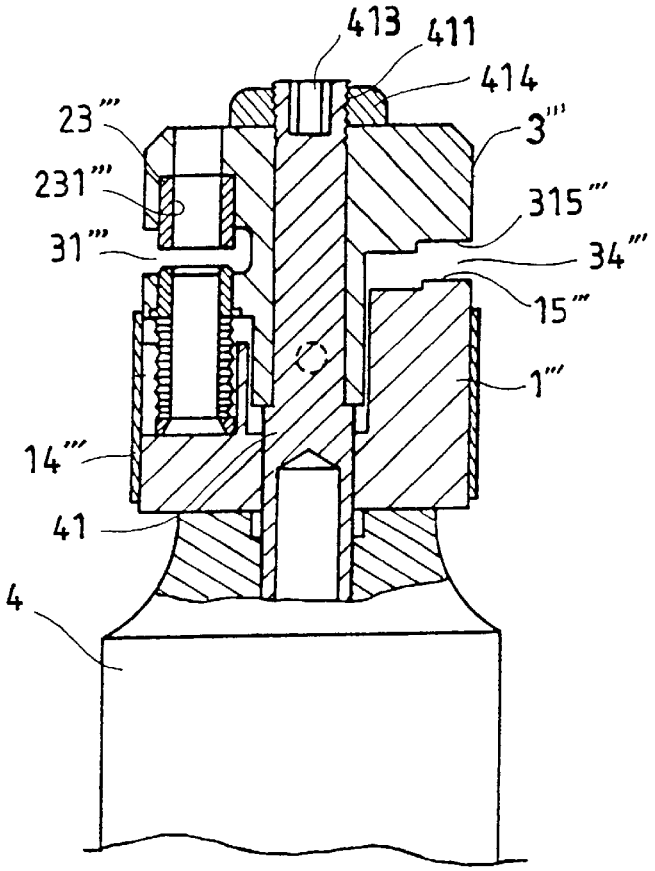
FIG. 10 is a sectional view of a portable punching machine according to a fifth embodiment of the present invention.
Figure 11:
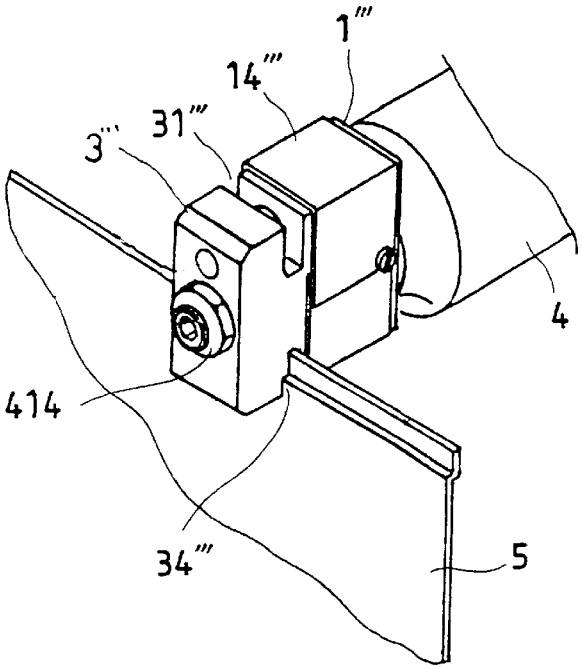
FIG. 11 is an elevational view showing the portable punching machine of the fifth embodiment of the present invention attached to the metal workpiece.
Figure 12:
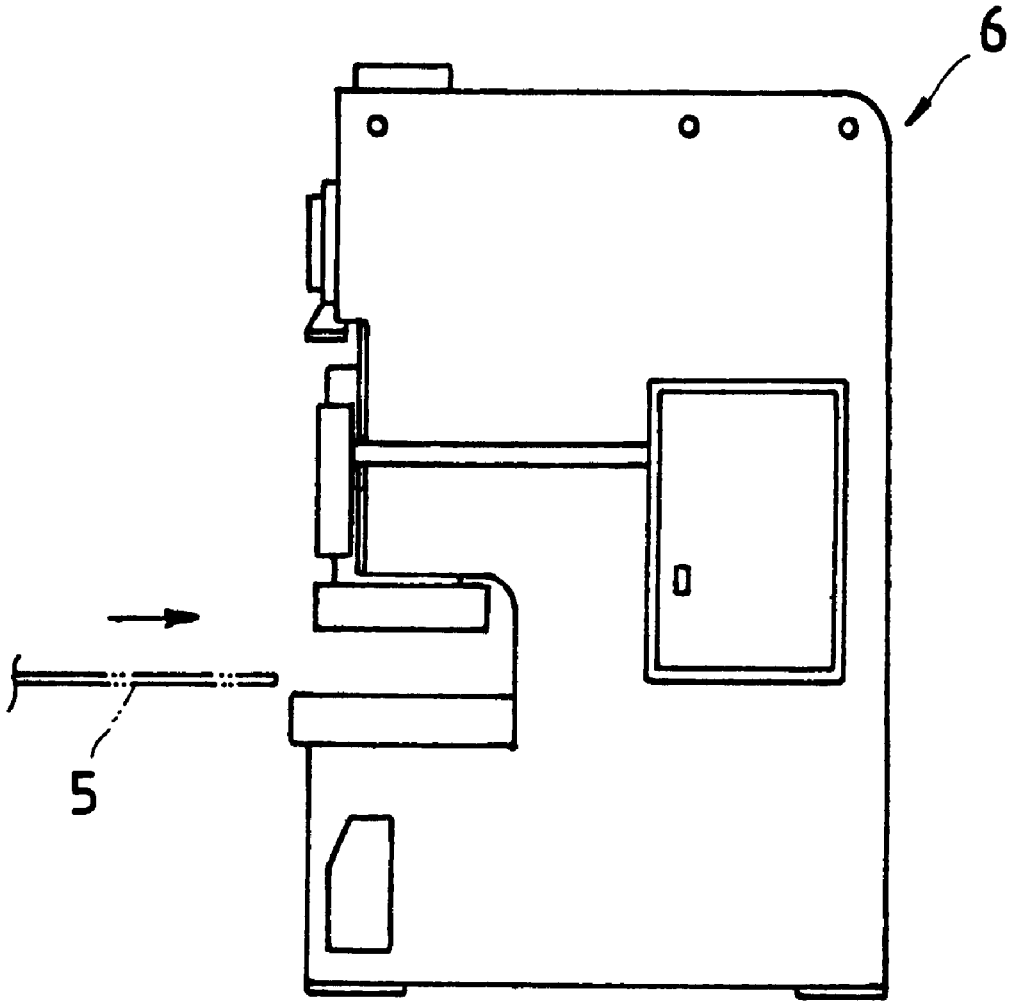
FIG.12 PRIOR ART
FIG. 12 is a side view of a conventional punching machine.

FIGS. 10 and 11 show a punching machine according to a fifth embodiment of the present invention. According to this embodiment, the locating block 1''' and the actuating block 3''' have a respective stepped crimping side 15''' or 315'''. The stepped crimping side 15''' of the locating block 1''' defines with the stepped crimping side 315''' of the actuating block 3''' a mouth 34''' adapted to crimp the metal workpiece 5. The stepped crimping side 15''' of the locating block 1''' and the stepped crimping side 315''' of the actuating block 3''' are so made that a clearance is left between the stepped crimping side 15''' of the locating block 1''' defines with the stepped crimping side 315''' of the actuating block 3''' when the actuating block 3''' is moved with the piston rod 41 and closed on the locating block 1'''. The clearance prevents the punching machine from damaging the metal workpiece 5 when crimping the metal workpiece 5.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A portable punching machine comprising a pneumatic cylinder, said pneumatic cylinder comprising a piston rod, and a punching mechanism coupled to said piston rod of said pneumatic cylinder and driven by said piston rod to punch holes in a metal workpiece, wherein said punching mechanism comprises:

a locating block fixedly fastened to said pneumatic cylinder, said locating block comprising at least one bottom notch, and a center through hole adapted to receive the piston rod of said pneumatic cylinder;

an actuating block mounted on the piston rod of said pneumatic cylinder and adapted to move the workpiece to be processed relative to said locating block, said actuating block comprising a center through hole fastened to the piston rod of said pneumatic cylinder by a lock nut, at least one peripheral side notch for coupling to the metal workpiece to be processed, and at least one pair of guide holes aligned at two sides of said at least one peripheral side notch and respectively aimed at the at least one bottom notch of said locating block; and at least one punching tool assembly mounted in said locating block and said actuating block and driven by said actuating block to punch the metal workpiece being attached to the at least one side notch of said actuating block upon operation of said pneumatic cylinder, said at least one punching tool assembly each comprising a barrel mounted in one of said pair of guide holes of said actuating block, a set of spring washers mounted in said at least one bottom notch of said locating block, a punching rod mounted in said at least one bottom notch of said locating block and inserted through said set of spring washers and said barrel, and a punching die mounted on said one of said pair of guide holes of said actuating block and aimed at said barrel.

2. The portable punching machine of claim 1 wherein said piston rod of said pneumatic cylinder has a hexagonal end hole.

3. The portable punching machine of claim 1 wherein said at least one bottom notch comprises two bottom notches disposed at two sides of the center through hole of said locating block; said at least one punching tool assembly includes one punching tool assembly mounted in one of said two bottom notches of said locating block; said actuating block further comprising a stop block mounted in said peripheral side notch, an adjustment screw controlled to move said stop block in said peripheral side notch to limit an insertion depth of the metal workpiece to be processed into said peripheral side notch, and a guide rod supported on spring washers in the other of said two bottom notches of said locating block.

4. The portable punching machine of claim 1 wherein said actuating block comprises a neck surrounded by said at least one side notch, said neck having at least one peripheral side respectively suspending in said at least one side notch for stopping against one side edge of the metal workpiece to be processed to serve as a reference line.

5. The portable punching machine of claim 1 wherein said locating block has a stepped crimping side facing said actuating block, and said actuating block has a stepped crimping side facing the stepped crimping side of said locating block and defining with the stepped crimping side of said locating block a crimping mouth adapted to crimp the metal workpiece to be processed.

6. The portable punching machine of claim 5 wherein the stepped crimping side of said locating block and the stepped crimping side of said actuating block are so made that a clearance is left between the stepped crimping side of said locating block and the stepped crimping side of said actuating block when said actuating block is moved with said piston rod and closed on said locating block.

7. The portable punching machine of claim 1 wherein said at least one punching tool assembly includes a plurality of punching tool assemblies, and the punching rods of said punching tool assemblies have different diameters for punching holes of different diameters on the metal workpiece.

* * * * *